US006557321B1

(12) United States Patent
Coveney

(10) Patent No.: US 6,557,321 B1
(45) Date of Patent: May 6, 2003

(54) APPARATUS FOR FORMING A PACK

(75) Inventor: Keith Robert Coveney, Bristol (GB)

(73) Assignee: Bradman-Lake Limited, Bristol (GB)

( * ) Notice: Subject to any disclaimer, the term of this patent is extended or adjusted under 35 U.S.C. 154(b) by 0 days.

(21) Appl. No.: 09/564,986

(22) Filed: May 5, 2000

(30) Foreign Application Priority Data

May 5, 1999 (GB) ..... 9910309

(51) Int. Cl.[7] ..... B65B 41/02; B65B 41/04

(52) U.S. Cl. ..... 53/176; 53/374.7; 53/375.5; 53/399; 53/499; 53/582

(58) Field of Search ..... 53/399, 449, 176, 53/586, 590, 582, 482, 374.7, 375.5

(56) References Cited

U.S. PATENT DOCUMENTS 3,973,372 A * 8/1976 Omori ..... 53/222
4,144,697 A * 3/1979 Suga ..... 53/206
4,483,125 A * 11/1984 Suga ..... 53/372.5
4,571,927 A * 2/1986 Suga ..... 53/206
4,757,666 A * 7/1988 Janhonen ..... 53/176
4,841,715 A * 6/1989 Suga ..... 493/479
5,402,624 A * 4/1995 Suga ..... 53/374.7
5,452,561 A * 9/1995 Thompson et al. ..... 53/399
5,806,279 A * 9/1998 Spatafora ..... 53/399

* cited by examiner

*Primary Examiner*—Rinaldi I. Rada
*Assistant Examiner*—Hemant M. Desai
(74) *Attorney, Agent, or Firm*—Young & Thompson

(57) ABSTRACT

A tray pack assembly 10 is conveyed through a package forming machine during a final gluing stage by angled continuous belts 37, 38 which drivingly engage side walls of the forming pack 10 and support the pack 10 throughout this operation. To ensure good contact between the pack 10 and the belts 37, 38 and subsequently good contact with compression rollers of a later conveyor bed, two belts 39, 40 of flexible fingers 41 extend above the path of travel so that the tips 42 of the fingers 41 engage the top 14. The provision of these flexible fingers 41 enables deflection of the fingers 41 in the event of the tray having contents which stick above the intended level. The belts 37, 38 enable the spatial relationship between the walls of the pack 10 to be controlled precisely and for squared-off sleeves to be formed thereby.

10 Claims, 7 Drawing Sheets

APPARATUS FOR FORMING A PACK

BACKGROUND OF THE INVENTION

This invention relates to apparatus for forming a pack of the type comprising a contents-containing tray and a surrounding sleeve.

Packs of this sort are particularly used in the food industry for pre-prepared meals, for example microwaveable meals. Traditionally the food packer purchases a pre-manufactured sleeve, which is erected and the tray is then fed into it. This separate manufacture of the sleeves is expensive and the erecting and filling of the sleeves tends to be somewhat labour intensive.

Proposals have been made for forming such a pack by folding the sleeve around a tray, gluing one of the free edges and then bringing the free edges, or a stick flap on one of the free edges, together to form a sleeve around the tray. This presents certain conveying problems because the usual conveyor bed with upstanding moving lugs, cannot be used for the section of the machine in which the bottom of the sleeve needs to be swung upwardly to engage the stick flap on the other side wall. For this operation to happen the bed has to be substantially open and the solution to date has been to convey the pack through this section using a pair of dependent lugs which engage the trailing edge of the tray and sleeve. This arrangement allows for relative movement between the sleeve and tray in a manner which often results in sleeves being glued when they are not properly squared off, resulting in skewed sleeves. It can also be difficult to exert good downward pressure on the pack using this system and so gluing may be incomplete.

SUMMARY OF THE INVENTION

From one aspect the invention consists in apparatus for forming a pack comprising a contents-containing tray and a surrounding sleeve, the apparatus including conveying apparatus for conveying a tray along a path of travel, a plurality of stations disposed along said path, including a feed station for placing a foldable sheet, which defines a top, two side walls, a bottom and a flap attached respectively to said two side walls, onto the top of the tray, a first folding station for folding said side walls to lie adjacent the sides of the tray, a gluing station for gluing one or both of said flap and said bottom, and a second folding station for folding said bottom against said flap to engage the two together and complete the sleeve, characterised in that the second folding station includes drive means for engaging said side walls to drive the pack through the station whilst maintaining a predetermined spatial relationship between said side walls.

In a preferred embodiment said drive means fully support the pack for at least part of the travel through the second folding station.

It will be understood that by utilising the drive means to control the spatial relationship of the side walls, the sleeve can always be properly orientated when gluing occurs.

The drive means may comprise an independent drive element or elements for each drive wall such that the drive elements can be driven at different speeds to achieve the predetermined spatial relationship. In normal use, the respective speeds will be preset to suit a particular tray and sleeve combination, but sensors may be provided for achieving real time adjustments of the speeds.

It is particularly preferred that the drive means should be constituted by belts and that the belts may be inclined towards each other to support the pack.

In any of the above arrangements the apparatus may further include flexible pressure elements for exerting downward pressure on the pack as it passes through at least part of the second folding station. These flexible elements can not only enhance the gluing operation through added compression, they can also help to ensure that the packs are properly located onto the drive means and maintained in good driving relationship with the drive means. Preferably there are two sets of flexible pressure elements and the flexible elements may be adjustable both vertically and laterally with respect to the path of travel to allow for different pack sizes and the like. The flexible elements may be pivotally mounted to allow access to the path of travel.

From a second aspect the invention consists in an apparatus for forming a pack comprising a contents-containing tray and a surrounding sleeve, said apparatus including conveying apparatus for conveying a tray along a path of travel, a plurality of stations disposed along said path, including a feed station for placing a foldable sheet, which defines a top, two side walls and a bottom and a flap attached respectively to said two side walls, on the top of the tray, a first folding station for folding said side walls to lie adjacent the sides of the tray, a gluing station for gluing one or both of said flap and said bottom, and a second folding station for folding said bottom against said flap to engage the two together and complete the sleeve, characterised in that the second folding station includes a pair of opposed drive belts for drivingly engaging and supporting the pack.

The drive belts may be angled towards each other and one belt may be less deep than the other, to enable sleeves with a "foot" to be formed. Preferably the belts are independently driven.

In either of the above aspects of the invention belts have been specifically identified as the preferred form of drive means, but it is to be understood that rollers or chain and lug conveyers may provide at least some of the advantages of the specific embodiments and are incorporated within the invention.

From a still further aspect the invention consists in apparatus for forming a pack comprising a contents-containing tray and a surrounding sleeve, said apparatus including conveying apparatus for conveying a tray along a path of travel, a plurality of stations being disposed along said path, including a feed station for placing a foldable sheet, which defines a top, two side walls and a bottom and a flap attached to respectively to two side walls, on top of the tray, a first folding station for folding said side walls to lie adjacent the sides of the tray, a gluing station for gluing one or both of said flap and said bottom, and a second folding station for folding said bottom against said flap to engage the two together and complete the sleeve, characterised in that the second folding station includes flexible pressure elements for pushing downwardly on the pack.

The use of flexible pressure elements is particularly beneficial, because it prevents jamming or similar problems occurring, in those cases where the contents accidentally project above the top of the tray.

Although the invention has been defined above it is to be understood that it includes any inventive combination of the features set out above or in the following description.

BRIEF DESCRIPTION OF THE DRAWINGS

The invention may be performed in various ways and a specific embodiment thereof will now be described, by way of example, with reference to the accompanying drawings, in which.

DESCRIPTION OF THE PREFERRED EMBODIMENTS

Figure 1:
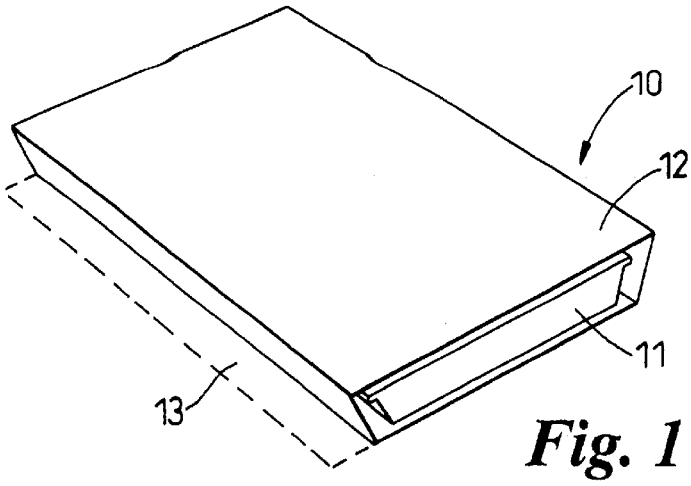
FIG. 1 is a perspective view of the pack of the type that the apparatus of this invention is intended to form.

As has been indicated above the applicants seek to form packs comprising a contents-containing tray surrounded by a sleeve. Such a pack 10 is illustrated in FIG. 1 and it will be seen that the tray 11 is surrounded by a sleeve 12 formed from cardboard or a suitable sheet material. The sleeve is usually printed to identify the contents of the tray and may include such things as cooking instructions. Alternative forms of packs 10 are known in which a foot (as indicated in dotted line at 13) is included to enable the tray to be displayed vertically.

Turning to FIG. 2, a method by which the sleeve 12 may be wrapped around the tray 11 is illustrated. These steps are essentially known in the art. The sleeve 12 comprises a top 14, side walls 15, 16, a bottom 17 and a flap 18. These elements are defined in a single sheet by means of fold lines 19. The sleeve 12 is placed in its flat form (see FIG. 2A) onto the tray 11 so that the top 14 lies on the top of the tray 11. In a first step the side walls 15, 16 are ploughed downwardly so that they lie adjacent the corresponding side walls of the tray 11 and glue is applied on the inner face 20 of the bottom 17 adjacent its free edge 21 (see FIG. 2B). The flap 18 and bottom 17 are then ploughed upwardly (see FIG. 2C) until the adhesive 22 on the bottom 17 is brought into contact with the flap 18 and compressed against it to form the finished sleeve (FIG. 2D).

Figure 2A:
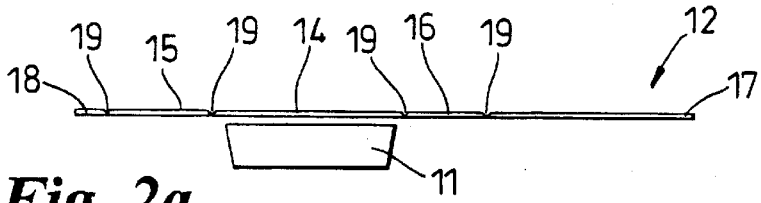
FIGS. 2A to 2D are schematic views illustrating the formation of such a pack, with the sleeve enlarged in FIG. 2A to illustrate the fold lines.
Figure 2B:
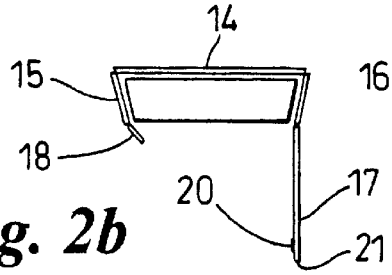
Figure 2C:
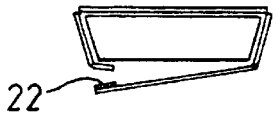
Figure 2D:
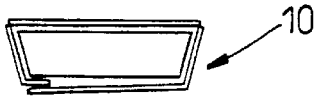
Figure 3:
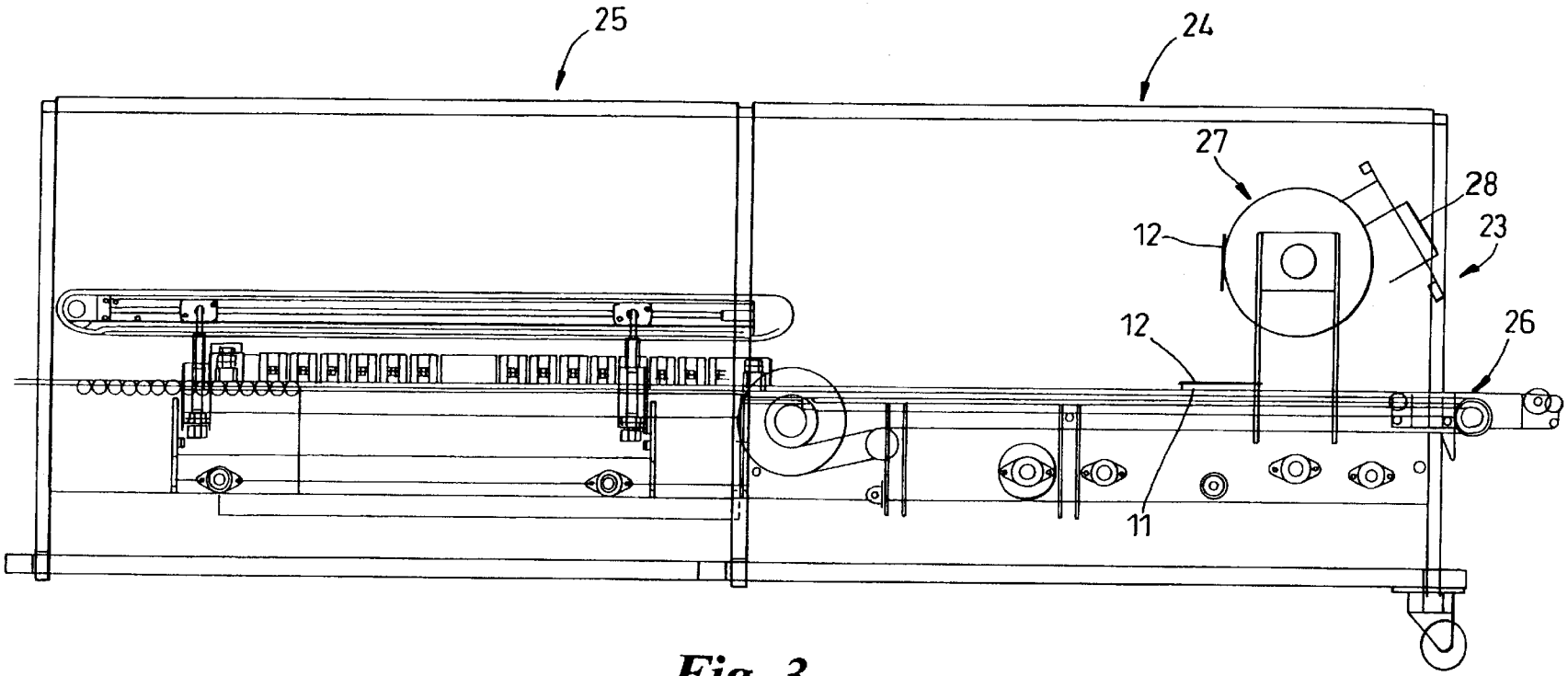
FIG. 3 is a schematic side view of the apparatus of an embodiment of the invention.

FIG. 3 illustrates apparatus for performing the steps set out in FIG. 2. The apparatus 23 is essentially divided into two stages 24 and 25. Although very much to the applicants design, the function of the first stage is essentially conventional and takes the process up to the point of the application of the glue 22 as illustrated in FIG. 2B. In contrast the second stage 25 incorporates a significant new approach to performing the steps shown in 2C and 2D.

The first stage includes a conveyor, which is generally indicated at 26, which defines a horizontal path of travel from right to left for trays 11 which are introduced onto its right hand end in a continuous stream. A carousel 27 is mounted above the conveyor 26 to draw sleeves 12, in sheet form, from a cassette 28 and to deliver them onto the trays 11 passing beneath. The carousel 27 rotates anti-clockwise as shown in FIG. 3. Temporary lugs (not shown) are provided for the squaring up of the sleeve 12 so that it lies on the tray 11 in the position shown in FIG. 2A.

Figure 4:
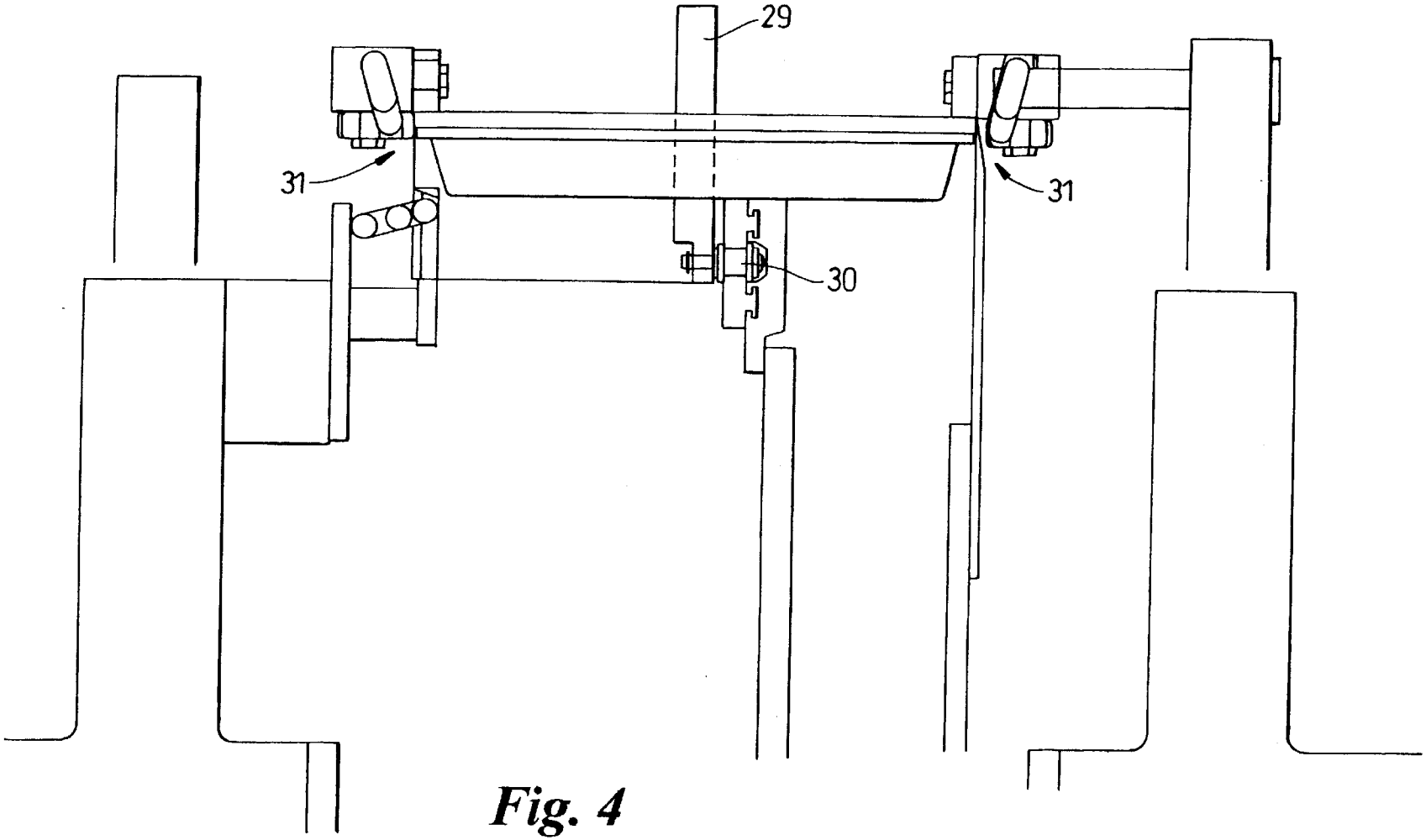
FIG. 4 is a vertical section through the apparatus shown in Figures.
Figure 5:
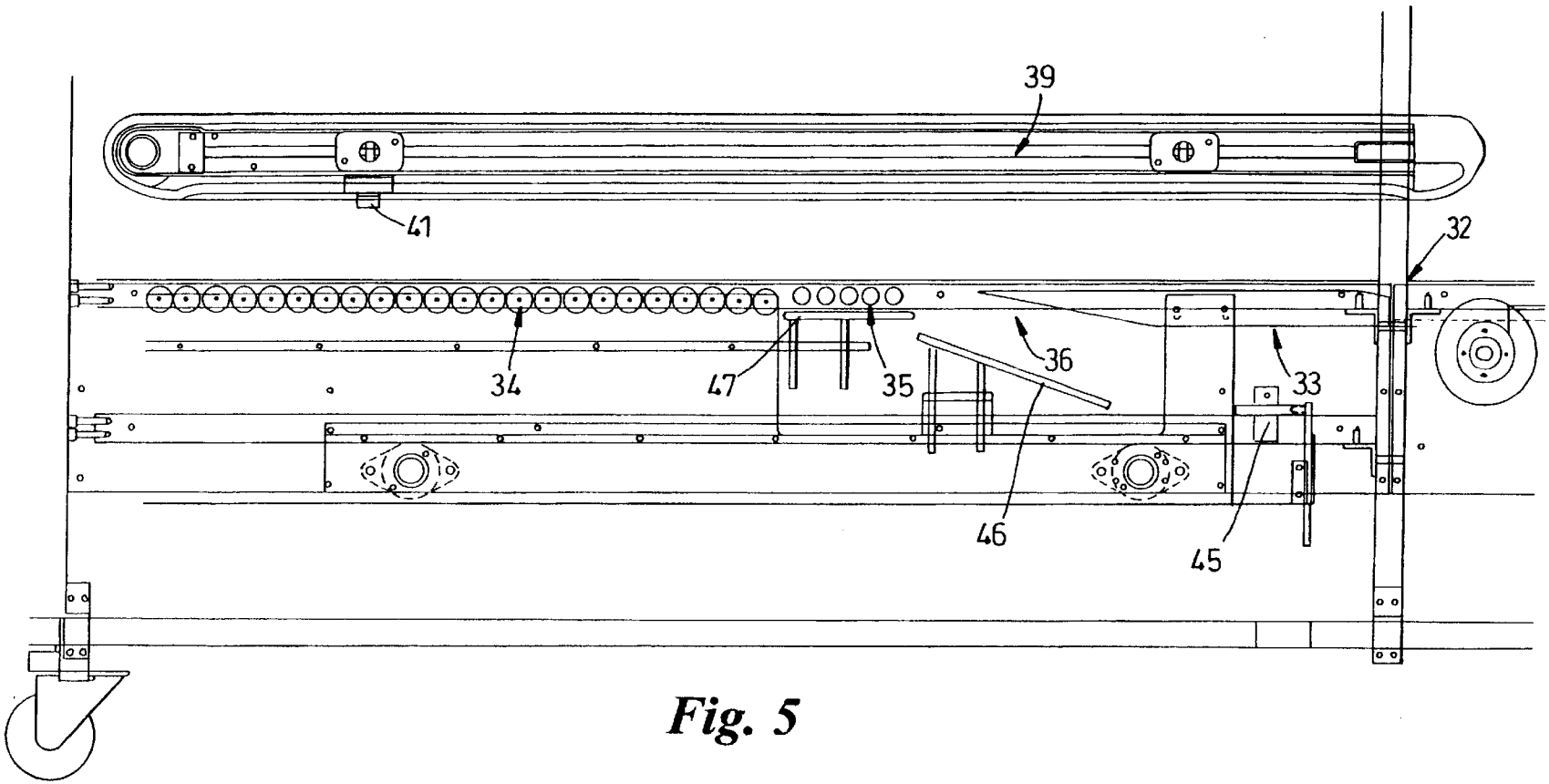
FIG. 5 is an enlarged side view of a second folding station of the apparatus of FIG. 3.
Figure 6:
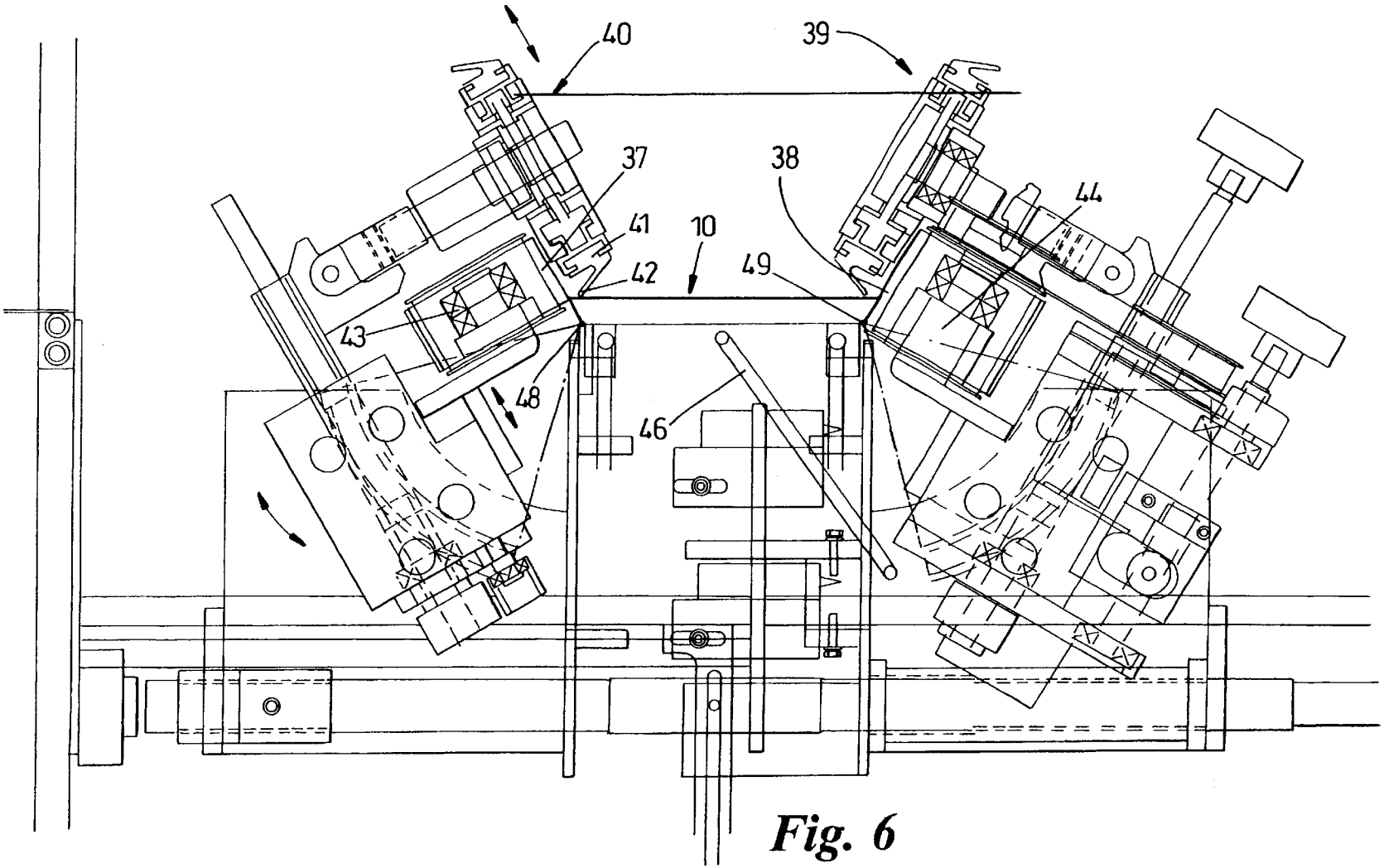
FIG. 6 is an end view of the station of FIG. 5.
Figure 7:
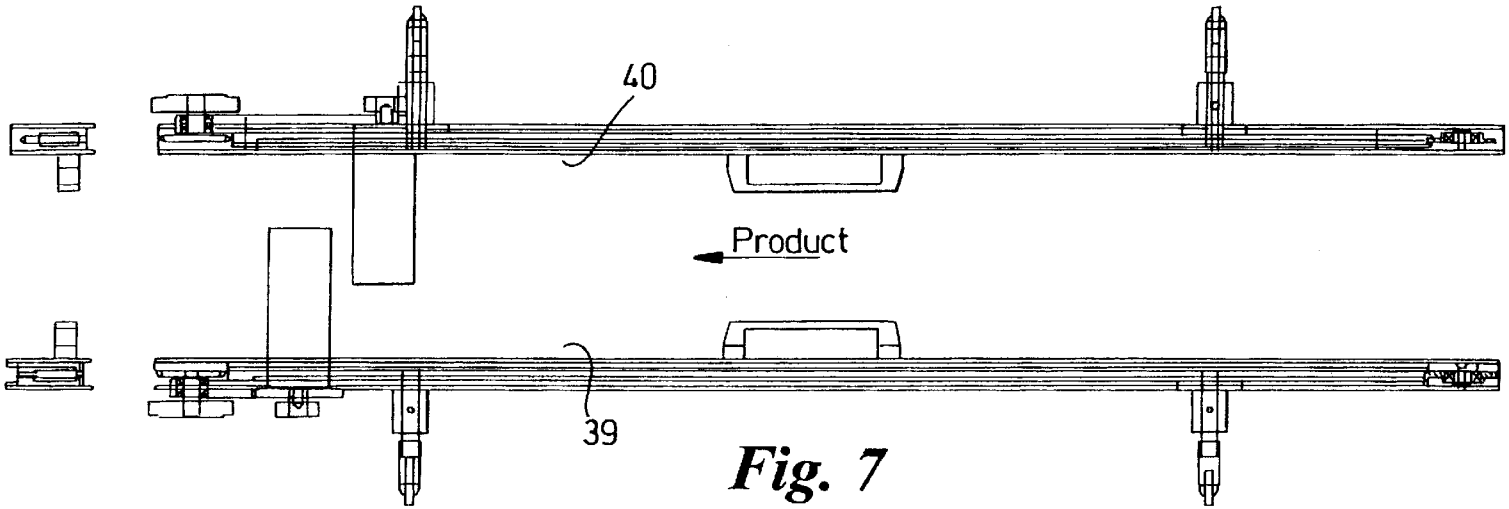
FIG. 7 is a view from above of flexible elements of the station of FIG. 5 and their drives.

As can be seen in FIG. 4 the tray and sleeve assemblies 11, 12 are pushed along the conveyor 26 by upstanding lugs 29 mounted on a chain 30. At the point illustrated in FIG. 4, rollers 31 have ploughed the side walls 15, 16 against respective knife edges so that they depend vertically as shown in FIGS. 4 and 2A. The tray pack assembly enters the second stage 25 at 32 (FIG. 5) in this condition. The path of travel in the second stage is initially defined by rails 33 and subsequently by compression rollers 34 and optional adjustment rollers 35. In order that the bottom 17 can be swung upwardly (see FIG. 2C) it is necessary that the bed of the path of travel is open at 36. As can be seen in FIG. 6, angled continuous belts 37, 38 extend along the whole of the path of travel in the second stage 25 to drivingly engage the forming pack 10 through the side walls 15 and 16 and further they support the pack 10 throughout this operation. To ensure good contact between the pack 10 and the belts 37, 38 and subsequently good contact with the compression rollers 34, two belts 39, 40 of flexible fingers 41 extend above the path of travel so that the tips 42 of the fingers 41 engage the top 14. The provision of these flexible fingers 41 enables deflection of the fingers 41 in the event of the tray having contents which stick above the intended level (e.g. a lump of frozen chicken).

The engagement of the forming pack 10 by the belts 37, 38 means that the spatial relationship between the walls 15, 16 can be precisely controlled and squared-off sleeves thereby formed. It will be understood that the drives 43, 44 for the belts can be driven at different speeds, thus overcoming any drag resulting from the ploughing or folding operation described below.

Returning to FIG. 5, a glue gun 45 is located beneath the rails 33, whilst a plough rail 46 is located below the gap 36. The plough rail 46 extends at an angle and upwardly across the path of travel so that it can progressively lift the bottom 17 to the position illustrated in FIG. 2C. At this point a further plough rail 47 takes over to hold the bottom 17 just short of the flap 18 whilst adjustment rollers 35 finally square off the sleeve. The forming pack 10 then moves along the compression rollers 34 where the final gluing operation takes place.

Thus as the forming pack 10 enters at 32 onto the rails 33 a line of glue 22 is formed on the inner face 20 by the glue gun 45. The dependent bottom 17 is then acted upon by the plough rail 46, as previously described.

Figure 8:
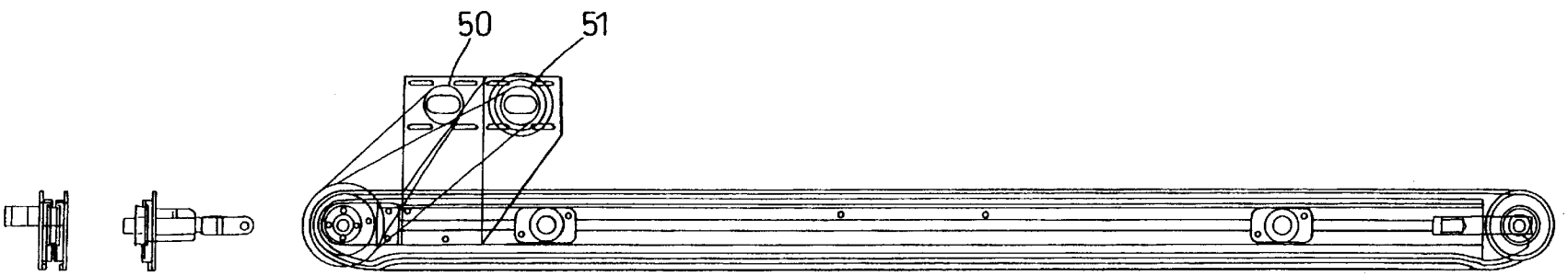
FIG. 8 is a side view of the arrangement of FIG. 7.
Figure 9:
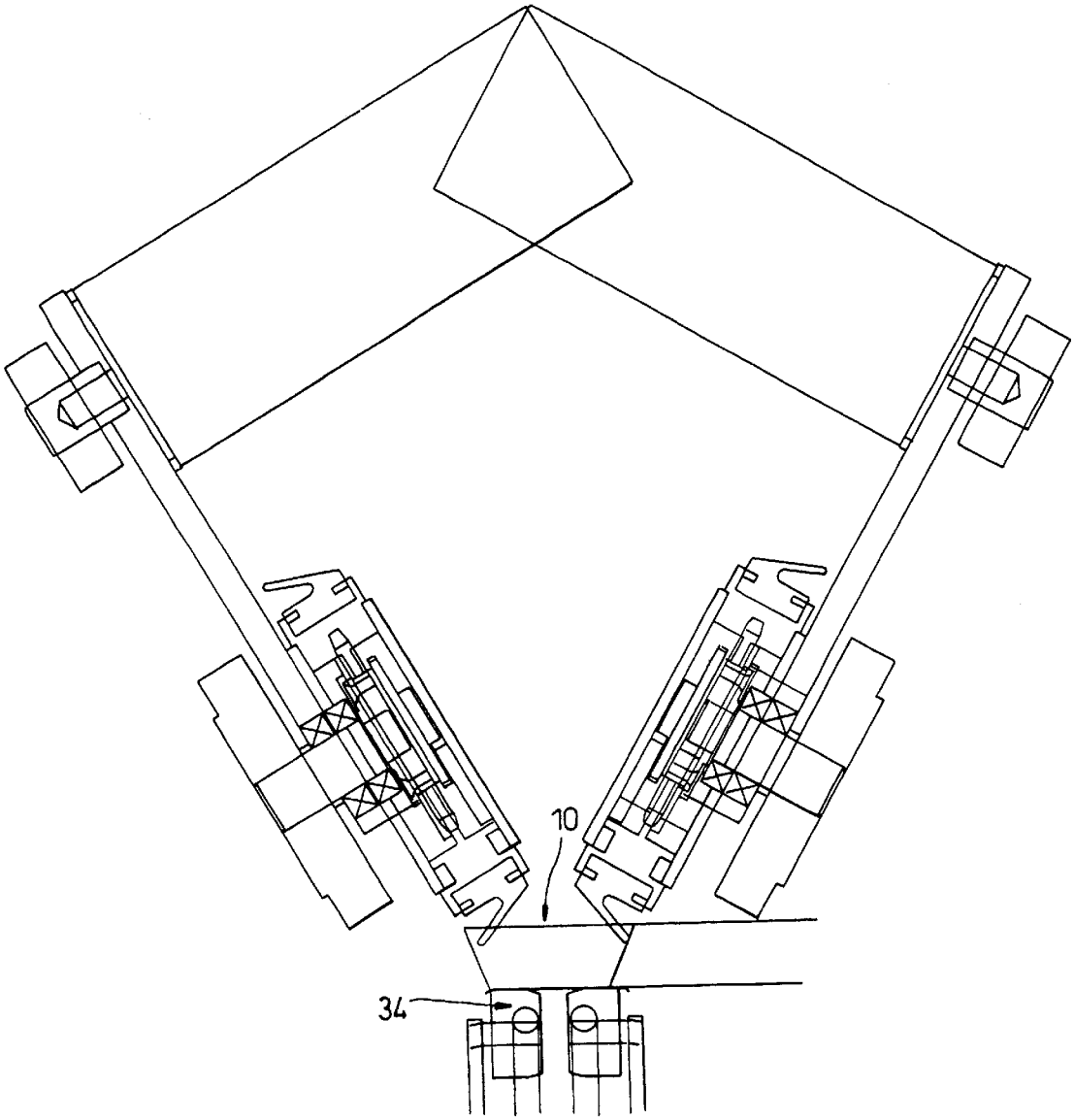
FIG. 9 is a vertical section through the apparatus shown in FIG. 5, the section having been simplified to assist understanding.

Returning to FIG. 6 it will be noted that the belt 37 is less deep than the belt 38 and this is to allow a space so that the apparatus can handle packs having feet 13. It will be noted that the finger belts 39, 40 are pivotally mounted so that they can be swung outwardly, about locuses 48, 49 to provide access to the path of travel. The belts 39, 40 can also be adjusted in their main plane to allow for packs 10 of different sizes and they can also be adjusted in the direction of their drive axes. Again independent drives 50, 51 are provided (FIG. 8).

In use, for any particular sleeve/tray design it has been found that certain drag conditions can exist as a result of the ploughing of the bottom 17. Because the belts 37, 38 are independently drivable it is possible to determine empirically the degree of drag for any particular pack design and to substantially compensate for that drag by driving the belts 37, 38 and in some cases 39, 40 at different speeds. Sleeves which contain tear strips to allow easy opening can be particularly problematic, because the resultant weaknesses can create distortion in the sleeve. In that event the additional optional rollers 35 may be necessary to provide further drag compensation.

Although the applicant's design introduces a number of substantial innovations, it should be particularly noted that the ability to drivingly engage the side walls in a continuous manner allows significant control of the forming pack and in particular the relationship between the sleeve and the tray. It also provides very positive support for the forming pack as it passes over the gap 36.

What is claimed is:

1. An apparatus for forming a pack with a contents-containing tray and a surrounding sleeve, the apparatus comprising:

conveying apparatus for conveying a tray along a path of travel; and a plurality of stations disposed along said path, including, a feed station for placing a foldable sheet for creating said sleeve, which sheet is preformed to define a top, two side walls, a bottom and a flap attached respectively to said two side walls, onto the top of the tray, a first folding station for folding said side walls to lie adjacent the sides of the tray, a gluing station for gluing one or both of said flap and said bottom, and a second folding station for folding said bottom against said flap to engage the two together and complete the sleeve, wherein the second folding station includes respective drive belts for engaging each of said side walls to drive and support the pack along the path of travel through the second folding station whilst maintaining a predetermined spatial relationship between said side walls, the drive belts being arranged to engage each side wall independently such that the drive belts can be driven at different speeds sufficient to maintain said predetermined spatial relationship between the two side walls.

2. The apparatus as claimed in claim 1 wherein the different speeds are preset prior to a production run.

3. The apparatus as claimed in claim 1 wherein the drive belts are inclined towards each other to support the pack.

4. The apparatus as claimed in claim 1 further including flexible pressure elements for exerting downward pressure on the top wall of the pack as it passes through at least part of the second folding station.

5. The apparatus as claimed in claim 4 wherein the flexible elements incorporate a drive mechanism for driving them along the path of travel.

6. The apparatus as claimed in claim 4 including two sets of flexible pressure elements.

7. The apparatus as claimed in claim 4 wherein the flexible elements are adjustable to allow for different size packs.

8. The apparatus as claimed in claim 4 wherein the flexible elements are pivotally mounted to allow access to the path of travel.

9. The apparatus as claimed in claim 1 wherein one said drive belt extends less far down to a bottom of said sleeve than does the other said drive belt.

10. An apparatus for forming a pack with a contents-containing tray and a surrounding sleeve, the apparatus comprising:

a conveying apparatus for conveying a tray along a path of travel; and a plurality of stations disposed along said path, including, a feed station for placing a foldable sheet that is to form the sleeve on a top of the tray, the sheet being preformed to define a top, two side walls, a bottom and a flap attached respectively to the two side walls, a first folding station for folding the side walls to lie adjacent the sides of the tray, a gluing station for gluing one or both of the flap and the bottom, and a second folding station for folding the bottom against the flap to engage the two together and complete the sleeve, wherein the second folding station includes a first drive means for urging one of the side walls along the path of travel through the second folding station at a first speed and a second drive means for urging the other one of the side walls along the path of travel through the second folding station at a second speed different from the first speed.

* * * * *